US008036542B2

(12) United States Patent
Jeon

(10) Patent No.: US 8,036,542 B2
(45) Date of Patent: Oct. 11, 2011

(54) IMAGE FORMING APPARATUS AND CONTROL METHOD THEREOF

(75) Inventor: Cheol-min Jeon, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 7 days.

(21) Appl. No.: 12/570,245

(22) Filed: Sep. 30, 2009

(65) Prior Publication Data

US 2010/0172659 A1 Jul. 8, 2010

(51) Int. Cl.
*G03G 15/00* (2006.01)

(52) U.S. Cl. ..... 399/12; 399/13; 399/25; 399/111

(58) Field of Classification Search ..... 399/9, 12, 399/24, 27, 30, 109, 111; 347/19, 85, 86
See application file for complete search history.

(56) References Cited

U.S. PATENT DOCUMENTS

| | | | | |
|---|---|---|---|---|
| 6,996,347 | B2 * | 2/2006 | Ito et al. | 399/12 |
| 7,239,815 | B2 * | 7/2007 | Takahashi | 399/12 |
| 7,280,772 | B2 * | 10/2007 | Adkins et al. | 399/12 |
| 7,512,347 | B2 * | 3/2009 | Suzuki et al. | 399/12 |

FOREIGN PATENT DOCUMENTS

KR 20090016294 2/2009

* cited by examiner

*Primary Examiner* — Hoan Tran
(74) *Attorney, Agent, or Firm* — Stanzione & Kim, LLP

(57) ABSTRACT

Disclosed are an image forming apparatus and a control method thereof. The control method of an image forming apparatus includes mounting a cartridge including a status indicating element, determining whether the mounted cartridge is a new one based on identification information of the mounted cartridge and status information of the status indicating element, and performing initial settings with respect to the new cartridge if it is determined that the mounted cartridge is a new one. With this, it is possible to induce a user to use an authenticated cartridge and prevent an image from being deteriorated and a component from being worn due to use of a fraudulent cartridge.

22 Claims, 4 Drawing Sheets

IMAGE FORMING APPARATUS AND CONTROL METHOD THEREOF

CROSS-REFERENCE TO RELATED APPLICATIONS

This application claims priority from Korean Patent Application No. 10-2009-0001571, filed on Jan. 8, 2009 in the Korean Intellectual Property Office, the disclosure of which is incorporated herein by reference in its entirety.

BACKGROUND

1. Field of the Invention

Apparatuses and methods consistent with the present general inventive concept relate to an image forming apparatus and a control method thereof, and more particularly to an image forming apparatus provided with a cartridge having a status indicating element and a control method thereof.

2. Description of the Related Art

An image forming apparatus forms an image onto a recording medium based on print data. The image forming apparatus is provided with a cartridge containing a developer to be supplied to form an image, and the cartridge needs to be replaced when it is used up.

A user may use a cheap and/or fraudulent cartridge with different properties than an authentic cartridge. Particularly, durability of a photosensitive body, a developing unit, or the like provided in an image forming unit of the image forming apparatus is designed to correspond to previously stored information about the authentic cartridge and information about the amount of developer used by the cartridge. Therefore, if the fraudulent cartridge is frequently used, the photosensitive body, the developing unit, or other components may be worn, the photosensitive body may not be cleaned or charged as needed, the developer may leak, an image may be deteriorated, and so on.

When an image is deteriorated, a user generally determines that the image forming apparatus is faulty, but the deteriorated image may be caused by use of the fraudulent cartridge.

In addition, user may remove a used cartridge from the image forming apparatus to replace it with a new one, or the user may temporarily remove a used cartridge from the image forming apparatus to fix a paper jam, clean the cartridge, or the like, and then mount the used cartridge again.

To distinguish between mounting a new cartridge and remounting a used cartridge, a conventional image forming apparatus allows a user to select whether the cartridge is new or used when the cartridge is mounted.

However, a user may mistakenly select that the cartridge is a used one even though it is a new one.

When this happens, the image forming apparatus controls the new cartridge based on the previously stored information about the amount of a used developer in the used cartridge, so that the image forming apparatus determines that the remaining amount of the developer is insufficient even though there is no lack of the developer. Therefore, problems may arise, including abnormally forming an image, prematurely requesting a replacement cartridge, and so on.

SUMMARY

Accordingly, the present general inventive concept provides an image forming apparatus and a control method thereof, which can induce a user to use an authentic cartridge and prevent an image from being deteriorated and a component from being worn due to use of a fraudulent cartridge.

The present general inventive concept also provides an image forming apparatus and a control method thereof, which can determine and inform a user whether a cartridge is new or used, thereby preventing an error due to a user's mistake in selection when the cartridge is mounted.

Additional aspects and utilities of the present general inventive concept will be set forth in part in the description which follows and, in part, will be obvious from the description, or may be learned by practice of the general inventive concept.

The foregoing and/or other features and utilities of the present general inventive concept can be achieved by providing a control method of an image forming apparatus, including: mounting a cartridge including a status indicating element; determining whether the mounted cartridge is a new one based on identification information of the mounted cartridge and status information of the status indicating element; and, if it is determined that the mounted cartridge is a new one, setting initial settings with respect to the new cartridge.

Setting the initial settings may include: resetting previously stored information about an amount of developer used; and forming an image based on a predetermined test pattern.

The control method may further include, if it is determined that the cartridge is a used cartridge, forming an image based on information previously stored in the image forming apparatus about an amount of a used developer.

The control method may further include notifying a user that the mounted cartridge is a new one or a used one according to the determined results.

The status information of the status indicating element may include information about whether the status indicating element is short-circuited.

The control method may further include short-circuiting the status indicating element if an amount of developer used by the mounted cartridge is equal to or larger than a preset value.

Short-circuiting the status indicating element may include applying a current having not less than a predetermined value to the status indicating element.

The control method may further include determining whether the mounted cartridge is authenticated based on the identification information of the cartridge.

The control method may further include, if the cartridge is not authenticated, disabling the image forming apparatus from forming an image or restricting at least one function of the image forming apparatus.

The control method may further include notifying a user whether use of the image forming apparatus is restricted.

The foregoing and/or other features and utilities of the present general inventive concept may also be achieved by providing an image forming apparatus including: an image forming unit which forms an image based on image data; a mounting unit to which a cartridge including a status indicating element is mounted; and a controller which determines whether the mounted cartridge is a new one on the basis of identification information of the mounted cartridge and status information of the status indicating element, and sets initial settings with respect to the cartridge if the mounted cartridge is a new one according to determined results.

The image forming apparatus may further include a memory unit to store information about an amount of developer used by the cartridge, wherein the controller sets initial settings by controlling the image forming unit to reset the information previously stored in the memory unit about the amount of the used developer, and forms an image based on a predetermined test pattern.

If the mounted cartridge is a used one, the controller controls the image forming unit to form an image based on the information previously stored in the memory unit about the amount of developer used.

The image forming apparatus may further include a notifying unit to notifying a user of the status information of the image forming apparatus, wherein the controller controls the notifying unit to notify a user that the mounted cartridge is a new one or a used one.

The status information of the status indicating element may include information about whether the status indicating element is short-circuited.

The image forming apparatus may further include a status setting unit capable of short-circuiting the status indicating element, wherein the controller controls the status setting unit to short-circuit the status indicating element if an amount of developer used by the mounted cartridge is equal to or larger than a preset value.

The controller may control the status setting unit to short-circuit the status indicating element by applying a current having not less than a predetermined value to the status indicating element.

The controller may determine whether the mounted cartridge is authenticated based on the identification information of the cartridge.

If the mounted cartridge is not authenticated, the controller may disable the image forming apparatus from forming an image or restrict at least one function of the image forming apparatus.

The image forming apparatus may further include a notifying unit to notify a user of the status information of the image forming apparatus, wherein the controller controls the notifying unit to notify a user whether use of the image forming apparatus is restricted.

The foregoing and/or other features and utilities of the present general inventive concept may also be achieved by a method of controlling an image forming apparatus, comprising: determining whether a cartridge is new or used based on status indicating data provided by the cartridge; if the cartridge is determined to be new, initializing the image forming apparatus to use the cartridge; and if the cartridge is determined to be "used," adjusting an output of the image forming apparatus to accommodate a level of developer used by the cartridge.

The method of controlling an image forming apparatus may further comprise determining whether the cartridge is authentic based on authentication data provided by the cartridge, wherein determining whether the cartridge is new or used is performed only if it is determined that the cartridge is authentic.

The method of controlling an image forming apparatus may further comprise, if it is not determined that the cartridge is authentic, preventing access to at least one function of the image forming apparatus that is accessible when it is determined that a cartridge is authentic.

The method of controlling an image forming apparatus may further comprise: continually monitoring an image output of the image forming apparatus to determine the level of developer used by the cartridge; and storing information regarding the level of developer used by the cartridge in the image forming apparatus. For example, continually monitoring an image output of the image forming apparatus may comprise counting dots used by the image forming apparatus to form an image.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
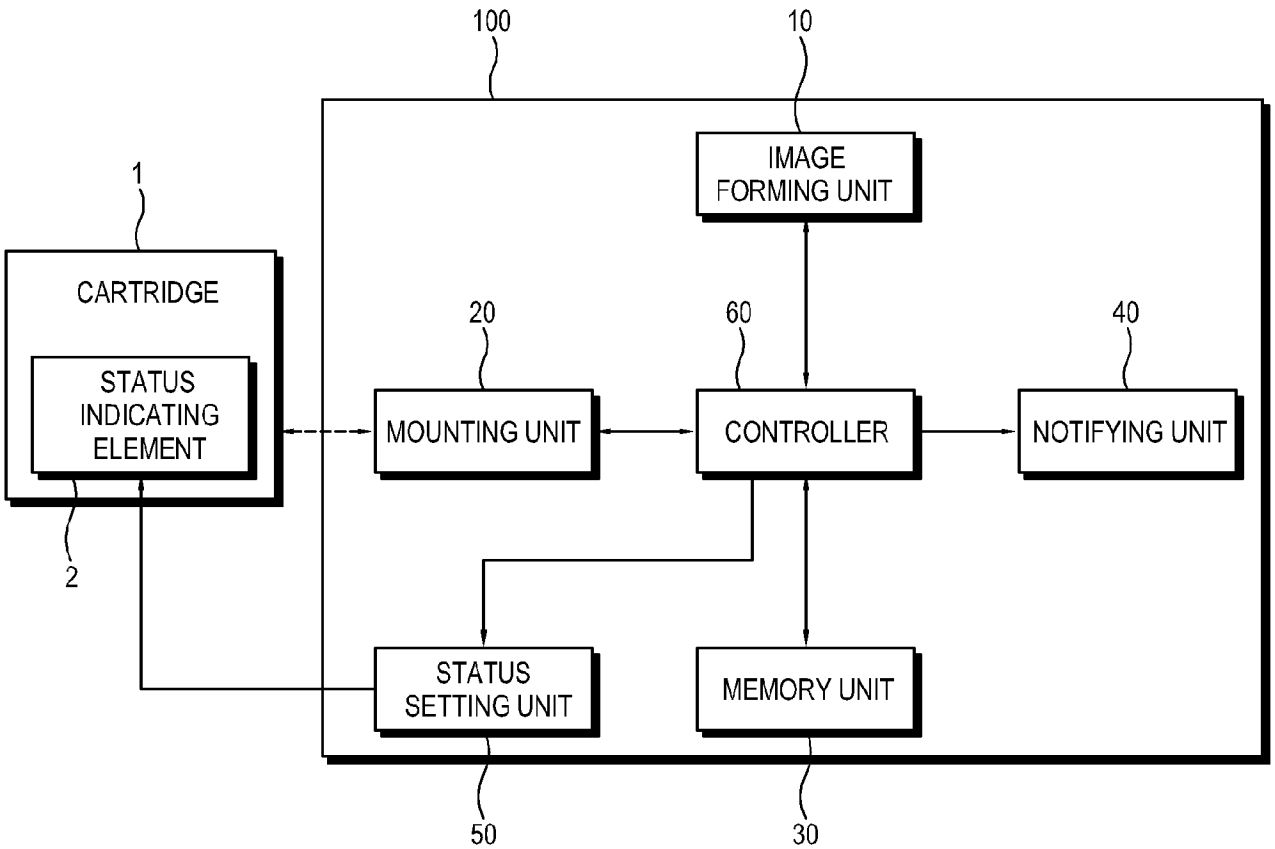
FIG. 1 is a block diagram of an image forming apparatus according to a first exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of an image forming apparatus according to an exemplary embodiment of the present general inventive concept. An image forming apparatus 100 in this embodiment may include an inkjet printer, an electrophotographic printer, a multi-function peripheral (MFP) having two or more functions, a copying machine, a facsimile, or the like, which can receive print data or print out stored print data.

As shown in FIG. 1, the image forming apparatus 100 may include an image forming unit 10, a mounting unit 20, a memory unit 30, a notifying unit 40, a status setting unit 50, and a controller 60. The image forming unit 10 receives developer from a cartridge 1 and forms an image onto a recording medium based on print data. The cartridge 1 includes a developer storage area 70 where developer is stored, and a status indicating element 2. The developer may include toner, ink, etc., and the toner or ink may correspond to mono color or various colors.

Further, the image forming unit 10 may include a photosensitive body (not shown) on which an electrostatic latent image may be formed, a developing unit (not shown) to develop developer on the photosensitive body, and a transferring unit (not shown) to transfer the developer from the photosensitive body to a recording medium (e.g., paper) and to form an image on the recording medium.

Additionally, the image forming unit 10 may include a jetting unit (not shown) to jet liquid ink to the recording medium based on print data.

The mounting unit 20 receives the cartridge 1 having the status indicating element 2. The status indicating element 2 provided in the cartridge 1 may be a fusible bit resistor having low resistance, and may be short-circuited by a current applied from the status setting unit 50 (to be described later) under control of the controller 60.

The controller 60 determines whether the mounted cartridge 1 is authenticated based on identification information, or authentication data, of the cartridge 1, and determines whether the mounted cartridge 1 is new or used based on status information, i.e., information about whether the status indicating element 2 is short-circuited.

A cartridge 1 connected to the image forming apparatus 100 may be an authentic cartridge compatible with the image forming apparatus 100, a non-authentic cartridge compatible with the image forming apparatus 100, or a non-authentic cartridge not compatible with the image forming apparatus 100. A cartridge not compatible with the image forming apparatus 100 will not allow the image forming apparatus 100 to perform any functions. While a non-authentic cartridge may allow the image forming apparatus 100 to perform functions, it may cause problems, as discussed above, including inordinate wear of components, faulty imaging, and faulty operation of the image forming apparatus 100. The cartridge 1 may include identification information, or authentication information, to allow the image forming apparatus 100 to determine whether the cartridge 1 is authentic or non-authentic, and to limit functionality of the image forming apparatus accordingly.

Figure 2:
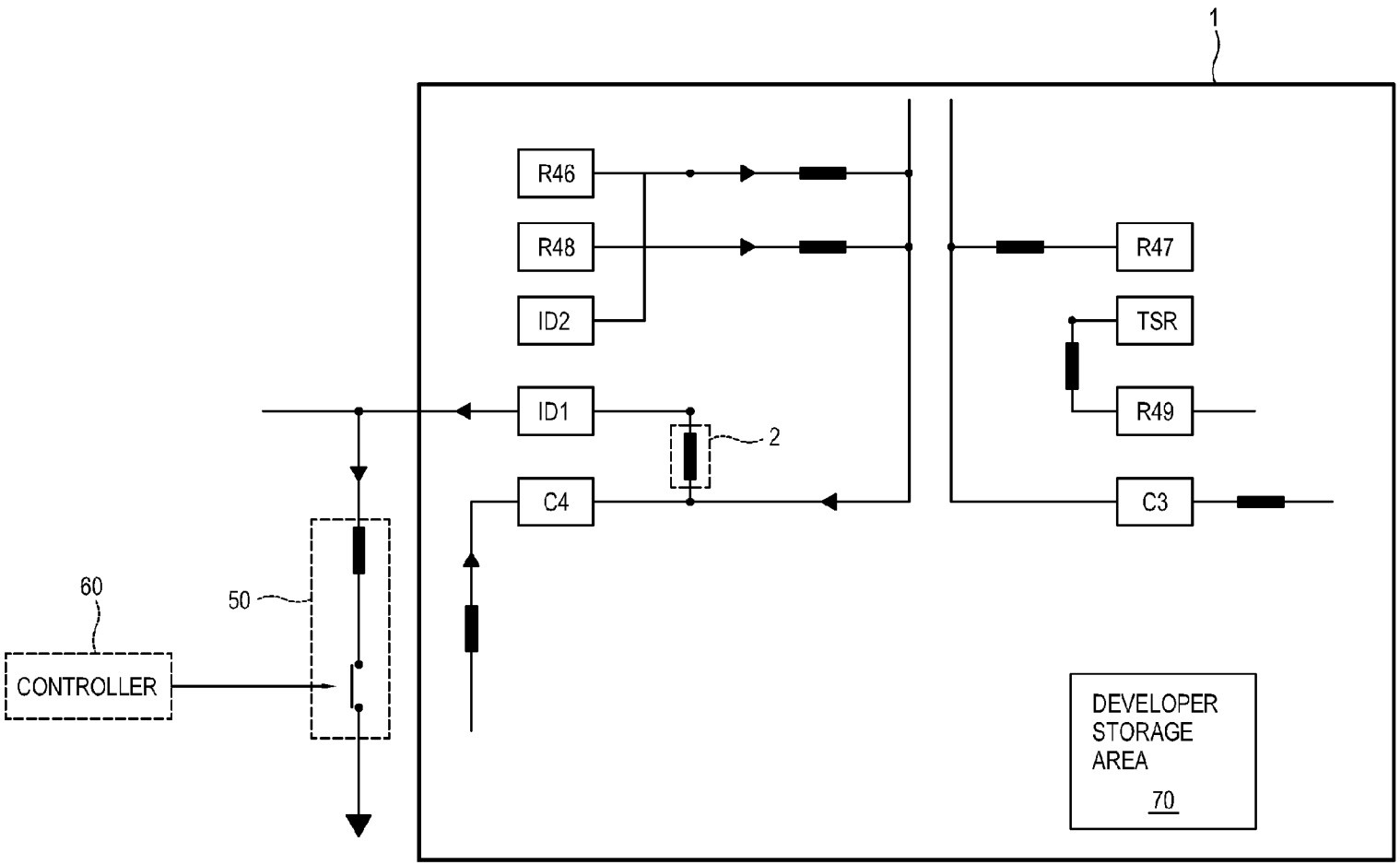
FIG. 2 is a circuit diagram of a cartridge and a status setting unit according to an exemplary embodiment of the present general inventive concept.

As shown in FIG. 2, the identification information of the cartridge 1 may include at least one data of a predetermined bit. For example, the identification information of the cartridge 1 may include ID1 and ID2. In this embodiment, the ID1 is 1, and the ID2 is 0.

The controller 60 compares the identification information of the cartridge 1 with the identification information stored in the memory unit 30, and thus determines whether the cartridge 1 is authentic.

The image forming apparatus 100 may also detect whether a cartridge 1 is new or used by detecting the status of the status indicating element 2. The status indicating element 2 may be a permanently alterable element, such as a fuse or fusible resistor, so that once it is altered to indicate a "used" status, it cannot be changed to a "new" status. For example, if the status indicating element 2 is a fusible resistor, it may be short-circuited to indicate that the cartridge 1 is "used." If a user removes the cartridge 1 from the image forming apparatus 100 and places it in the same or another image forming apparatus compatible with the image forming apparatus 100, the image forming apparatus may automatically detect that the cartridge is used. Even if the cartridge 1 is refilled with developer, the status would not change without replacing the status indicating element 2.

The mounting unit 20 may include an interface to interface the image forming apparatus 100 with the cartridge 1 so that the controller 60 may recognize the identification information and the status indicating element 2 of the cartridge 1. The image forming apparatus 100 may further include a status setting unit 50 to set the status indicating element 2 to a "used" status when a predetermined developer level is reached within the cartridge 1. For example, when the controller 60 determines that a predetermined developer level in the cartridge 1 has been reached, the controller 60 can direct the status setting unit 50 to set the status indicating element 2 of the cartridge 1 in a "used" state. If the status indicating element 2 is a fusible resistor, the status setting element 50 may short circuit the status indicating element 2 to permanently fuse the resistor.

The memory unit 30 may store information about the amount of developer used by the cartridge. Specifically, the controller 60 evaluates the amount of developer used by counting dots used to form an image with the cartridge 1 mounted to the mounting unit 20, and stores in memory unit 30 the evaluated information about the amount of developer used to generate the dots.

Thus, the controller 60 evaluates the amount of developer consumed as the image forming apparatus 100 forms an image, and continuously updates the information stored in the memory unit 30 about the amount of developer used.

When a cartridge is replaced by a new one, the controller 60 resets the information previously stored in the memory unit 30 about the amount of developer used by the removed cartridge, and evaluates the amount of the developer used by the new cartridge. The controller 60 may store in the memory unit 30 the evaluated information about the amount of developer used by the new cartridge 1. The controller 60 uses the information about developer used by the cartridge 1 to form an image based on received print data.

On the other hand, when a "used" cartridge 1 is re-mounted into the image forming apparatus 100, the controller forms an image based on received print data on the basis of the information previously stored in the memory unit 30 about the amount of developer used by the "used" cartridge 1.

The memory unit 30 may also store the identification information of the authenticated cartridge. The controller 60 determines whether the cartridge is authentic by comparing the identification information of the cartridge 1 recognized via the mounting unit 20 with the identification information stored in the memory unit 30. If the cartridge is not authentic, the image forming apparatus 100 may disable or restrict at least one function.

The restriction on at least one function of the image forming apparatus 100 may include restricting duplex printing in a duplex-type image forming device; restricting use of a high resolution (e.g., 1200 dpi, 2400 dpi or the like) higher than a reference resolution (e.g., 600 dpi); restricting a specific graphic mode such as a text mode, a gray mode and a solid mode; restricting a specific print density or a copy function; disabling or restricting printing, copying, or faxing; etc.

The memory unit 30 may further store information about a test pattern to initialize a new cartridge.

The memory unit 30 may also store print data received from an apparatus other than the image forming apparatus 100, such as from a host apparatus (not shown). If a facsimile machine, an MFP, or the like is used as the image forming apparatus 100, the memory unit 30 may store received fax data so that the image forming apparatus 100 can output the stored print data or fax data when the cartridge 1 is replaced by a new one and it is determined that the new cartridge is authentic based on its identification information.

The memory unit 30 may include an internal storage medium such as an HDD, or an external or portable storage medium such as a USB memory, a memory card (memory stick, compact flash (CF) card, a multi-media card (MMC)).

The notifying unit 40 notifies a user of status information of the image forming apparatus 100 under the control of the controller 60. For example, the notifying unit 40 may notify a user whether the mounted cartridge is new or used, or whether the cartridge is authentic.

Also, if the controller 60 restricts the use of the image forming apparatus 100, the notifying unit 40 may notify a user that some functions of the image forming apparatus 100 are restricted. For example, if the identification of the mounted cartridge 1 matches the identification information stored in memory unit 30, and the status indicating element 2 indicates a "used" status (e.g. a fuse is blown or a fused resistor is short circuited), then the notifying unit 40 may indicate to the user that the cartridge is authentic and "used." As a result, the status of the cartridge 1 is readily apparent to a user.

Likewise, if the identification information of the mounted cartridge 1 matches the identification information stored in the memory unit 30 and the status indicating element 2 is not set in a "used" status (e.g., an opened fuse), then the notifying unit 40 may notify a user that the cartridge is "new," and that the new and authentic cartridge may supply developer in a normal fashion without restrictions.

The notifying unit 40 in this embodiment may be a display unit such as a liquid crystal display (LCD) panel or the like. Alternatively, the notifying unit 40 may be an audio output unit or a server and a computer connected to the image forming apparatus 100, as long as it can notify a user of the foregoing status information. If the notifying unit 40 is a display unit, the controller 60 may notify a user of the status information of the image forming apparatus 100 in the form of a user interface (UI) image or text.

FIG. 2 is a circuit diagram of the cartridge 1 and the status setting unit 50 according to an exemplary embodiment of the present general inventive concept.

As shown in FIG. 2, the status setting unit 50 includes a switch and a resistor. The switch unit may have a configuration such as a transistor, a field effect transistor (FET), or the like, capable of applying a current to a circuit of the cartridge 1, or a configuration using a pulse width modulation (PWM), etc.

The controller 60 may evaluate the amount of developer consumed in forming an image, and may control the status setting unit 50 to short-circuit the status indicating element 2 if the evaluated amount of the used developer is equal to or larger than a preset value. To evaluate the amount of developer used, the controller 60 may count the dots used in forming an image, so that the amount of the used developer can be more precisely evaluated than that evaluated by counting pages or measuring the weight of the developer.

The preset value may be 3% to 7% of an initial amount of new developer contained in the cartridge 1.

For example, if the preset value is 5%, the controller 60 turns on the switch of the status setting unit 50 to apply a current to the status indicating element 2 to thereby fuse the status indicating element 2 when the amount of used developer is 5%, i.e., when the remaining amount of developer is 95%. Of course, the preset value may be variable according to the cartridge 1, the image forming apparatus 100, or the preset value may be established by the manufacturer or input by a user.

The controller 60 performs general control for the image forming apparatus 100. The controller 60 in this embodiment may be hardware such as a central processing unit (CPU) combined with software or firmware.

The controller 60 forms an image onto a recording medium based on print data, and if the cartridge 1 is mounted to the image forming apparatus 100, the controller 60 determines whether the mounted cartridge is authentic based on the identification information of the mounted cartridge. The controller also determines whether the mounted cartridge is "new" or "used" by reading the status information of the status indicating element 2.

In particular, the controller 60 recognizes the identification information of the cartridge 1 to determine whether the cartridge is authentic. If the identification information ID1 and ID2 stored in the cartridge does not match the identification information stored in the image forming apparatus 100, the controller 60 determines that the cartridge 1 is not authentic and disables the image forming apparatus 100 from forming an image or restricts at least one function of the image forming apparatus 100.

On the other hand, if the identification information of the cartridge 1 matches the identification information in the memory unit 30, the controller 60 determines that the cartridge 1 is authentic. The controller 60 then controls the image forming unit 10 to receive developer from the cartridge 1 and to form an image based on print data.

The controller 60 may also recognize the status information of the status indicating element 2 provided in the cartridge 1. If the status indicating element 2 is not set to a "used" status, the controller 60 determines that the mounted cartridge 1 is new and controls the notifying unit 40 to notify a user that the cartridge is new.

Then, the controller 60 may initialize the image forming apparatus 100 based on the authentication information and "new" status of the new cartridge 1. The initial settings may include resetting the information previously stored in the memory unit 30 about the amount of the used developer, and printing a test page by forming an image based on a predetermined test pattern.

Once the image forming apparatus is initialized with respect to the new cartridge 1, the controller 60 controls the image forming unit 10 to receive the developer from the cartridge 1 and to form an image based on received print data.

Further, the controller 60 evaluates the amount of developer used in forming an image. If the amount of used developer is equal to or larger than the preset value, the controller 60 controls the switch SW1 of the status setting unit 50 to be turned on to apply a current having not less than a predetermined value to the resistor connected to the status indicating element 2, so that the status indicating element 2 can be short-circuited. The status indicating element 2 may be placed between ID1 and C4 as shown in FIG. 2, and may have a low resistance of about 37 ohm, for example.

Thus, the controller 60 detects the short-circuited status indicating element 2 when the cartridge is mounted, thereby determining whether the cartridge 1 is "new" or "used."

If a user employs a used cartridge in which the developer has been re-filled, the controller 60 determines that the mounted cartridge is "used," since the status indicating element 2 is already short-circuited. Also, if the image forming apparatus 100 is configured to reset the cartridge information only when a "new" cartridge is detected, then when a re-filled cartridge is used, the information stored in the memory unit 30 regarding the amount of used developer is not reset, and an image formed using the re-filled cartridge will be faulty, thereby inducing a user to use an authentic cartridge that has not been re-filled.

On the other hand, if the status indicating element 2 indicates that the cartridge is "used," then the controller 60 determines that the mounted cartridge 1 is a used one, and controls the notifying unit 40 to notify a user that the cartridge is "used."

When the image forming apparatus 100 receives print data, the controller 60 controls the image forming unit 10 to receive the developer from the cartridge 1 based on the information previously stored in the memory unit 30 about the developer used by the cartridge, and then to form an image.

Thus, the information stored in the memory unit 30 about the amount of developer used by the cartridge 1 is continuously updated.

Further, the controller 60 evaluates the continuously-updated information regarding the amount of developer used to form an image. If the amount of developer used is equal to or larger than the preset value, the controller 60 turns on the switch SW1 of the status setting unit 50 so that a current having not less than a predetermined value can flow in the resistor connected to the status indicating element 2, thereby short-circuiting the status indicating element 2, for example.

According to an exemplary embodiment of the present general inventive concept, the image forming apparatus 100 notifies a user whether the cartridge 1 is authentic, and induces a user to use the authentic cartridge by restricting some functions if the cartridge is not authentic, based on the identification information of the cartridge 1 and the status information of the status indicating element 2.

Further, the image forming apparatus 100 determines whether the mounted cartridge is "new" or "used" and provides the results of the determination to a user. Automatically determining whether a mounted cartridge is new or used prevents user errors due to a user's mistake in selection when the cartridge is mounted.

Figure 3:
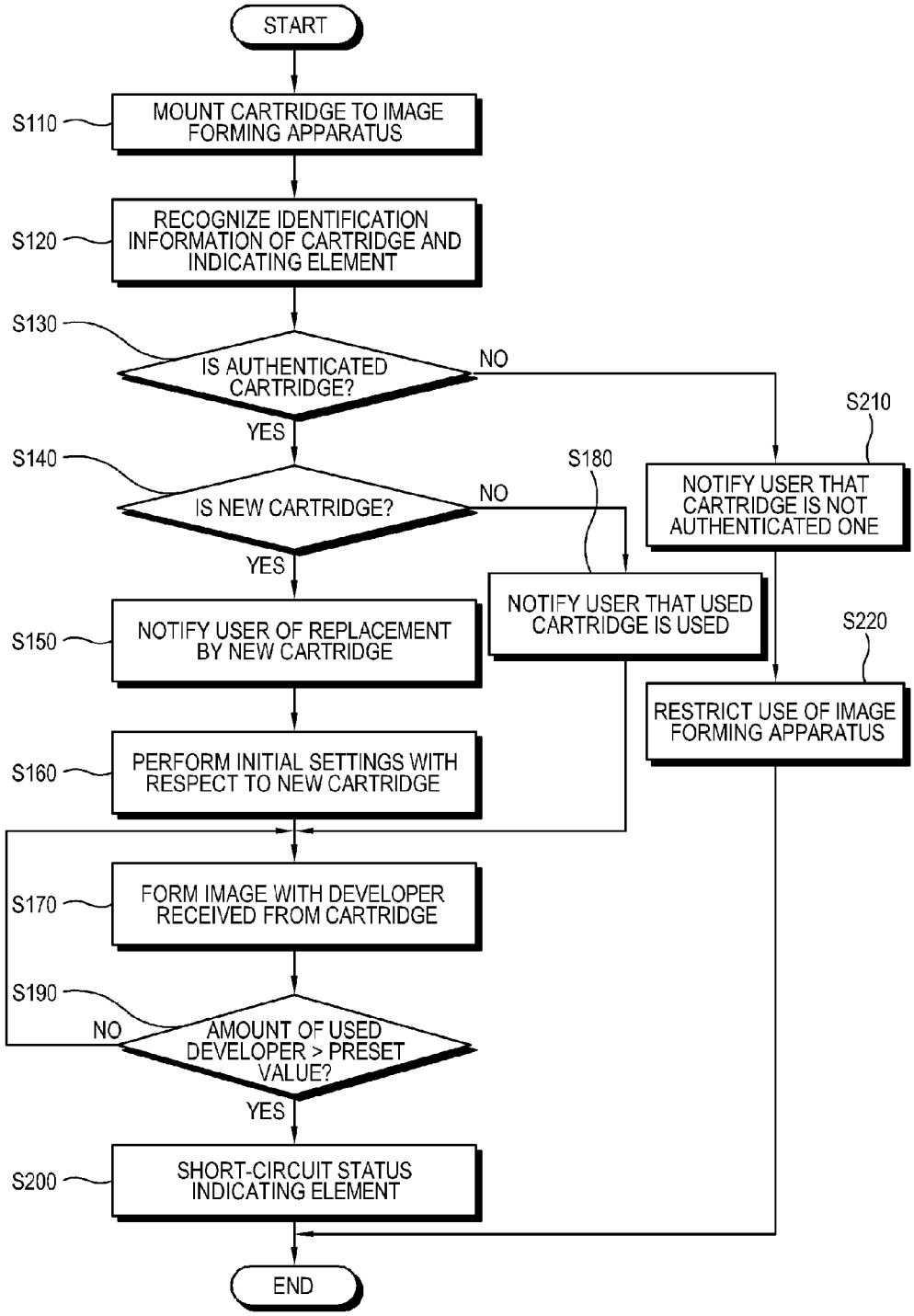
FIG. 3 is a control flowchart of an image forming apparatus according to an exemplary embodiment of the present general inventive concept.

A control method for the image forming apparatus 100 with the foregoing configuration will be described below with reference to FIG. 3.

At operation S110, a user mounts the cartridge 1 to the mounting unit 20 of the image forming apparatus 100. A user selects a cartridge replacing button provided on the image forming apparatus 100, removes the used cartridge and mounts a new cartridge.

At operation S120, the controller 60 recognizes the identification information of the cartridge 1 mounted in the operation S110 and the status information of the status indicating element 2.

At operation S130, the controller 60 compares the identification information of the cartridge 1 recognized in the operation S120 with the identification information stored in the memory unit 30, and determines whether the mounted cartridge 1 is authentic.

If the identification information of the mounted cartridge 1 matches the identification information stored in the memory unit 30 and it is determined in the operation S130 that the mounted cartridge 1 is authentic, at operation S140 the controller 60 determines whether the mounted cartridge 1 is new or used based on the status information of the status indicating element 2 recognized in the operation S120.

If the status indicating element 2 does not indicate that the cartridge 1 is "used," the controller 60 determines that the mounted cartridge 1 is new.

If it is determined in the operation S140 that the mounted cartridge 1 is new, then at operation S150 the controller 60 controls the notifying unit 40 to notify a user that the cartridge of the image forming apparatus 100 is new. For example, the notifying unit 40 may display a text "new."

At operation S160, the controller 60 sets the initial settings, or initializes the image forming apparatus 100, with respect to the new cartridge. The initial settings may include resetting the information previously stored in the memory unit 30 about the amount of the used developer and printing a test page by forming an image based on a predetermined test pattern.

At operation S170, the controller 60 controls the image forming unit 10 to receive the developer from the cartridge 1 and to form an image based on received print data. The controller 60 evaluates the information about the used developer by counting dots used in forming an image based on the print data, and continuously updates the information stored in the memory unit 30 about the amount of the used developer.

On the other hand, if the status indicating element 2 indicates that the cartridge 1 is "used," the controller 60 determines in the operation S140 that the authenticated cartridge is "used."

If it is determined in the operation S140 that the mounted cartridge 1 is "used," then at operation S180 the controller 60 controls the notifying unit 40 to notify a user that the cartridge is used. For example, the notifying unit 40 may display a text "used."

Then, at operation S170, the controller 60 controls the image forming unit 10 to receive the developer from the cartridge 1 and to form an image based on received print data. The controller 60 evaluates the information about the used developer by counting dots used in forming an image based on the print data, and continuously updates the information stored in the memory unit 30 about the amount of the used developer.

At operation S190, the controller 60 determines whether the amount of the used developer is equal to or larger than a preset value. For example, the preset value may be within a range from 3% to 7% of the initial amount of the developer in a new cartridge.

If it is determined in the operation S190 that the amount of the used developer is larger than the preset value, then at operation S200 the controller 60 controls the status setting unit 50 to set the status indicating element 2 in a "used" status. The operation S200 may further include an operation to notify a user of the status of the status indicating element 2 through the notifying unit 40.

On the other hand, if, in operation S130, it is determined that the identification information of the cartridge 1 does not match the identification information stored in the memory unit 30, then at operation S210 the controller 60 determines that the mounted cartridge 1 is not authentic and controls the notifying unit 40 to notify a user that the mounted cartridge 1 is not authentic.

At operation S220, the controller 60 may control the image forming unit 10 so that the image forming apparatus 100 cannot operate to form an image, or at least one function of the image forming apparatus 100 can be restricted.

If some functions of the image forming apparatus 100 are restricted in the operation S220, the controller 60 may perform the image formation of the operation S170 with respect to enabled functions.

Figure 4:
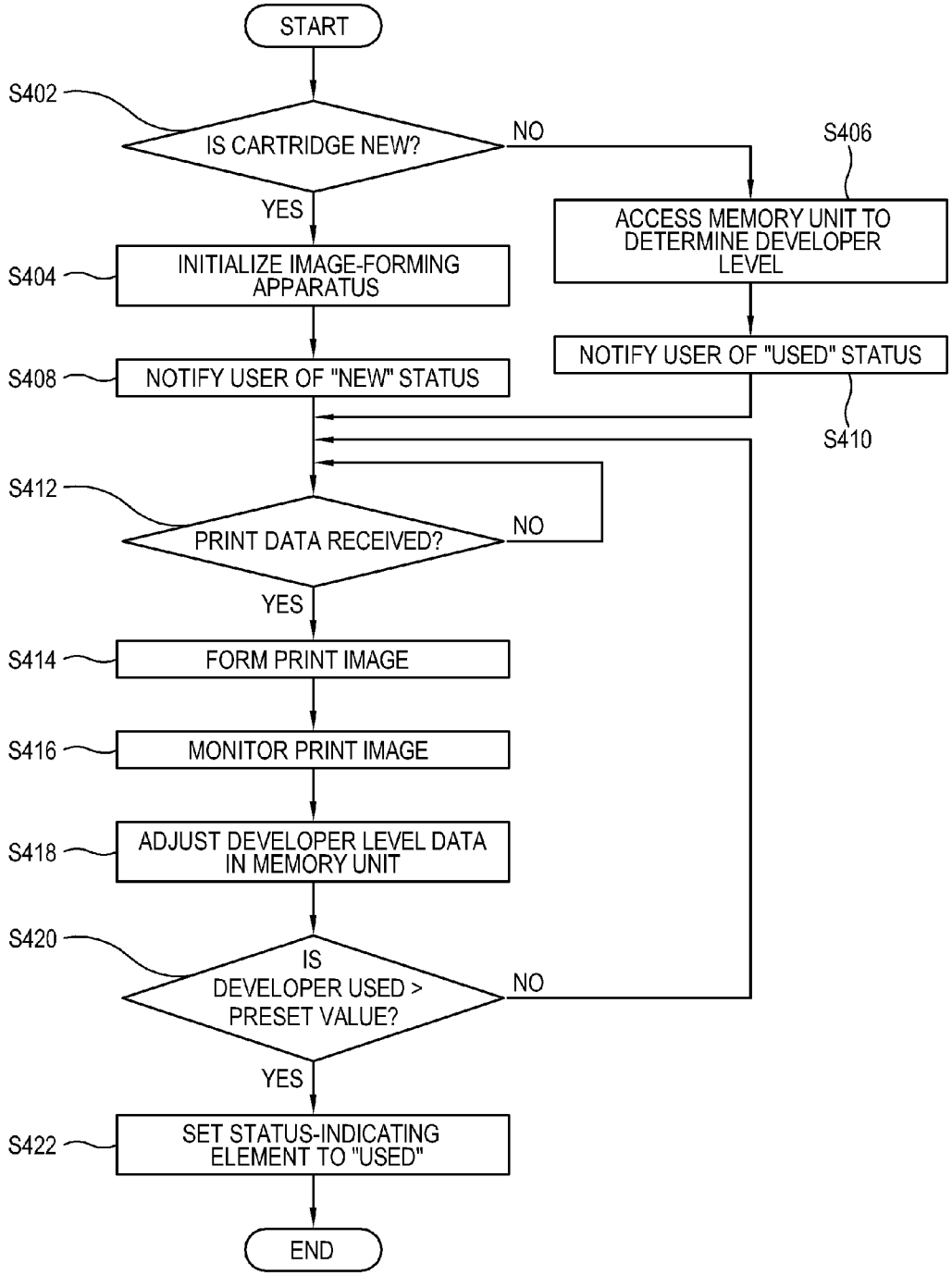
FIG. 4 is another control flowchart of an image forming apparatus.

A method to control the image forming apparatus 100 according to another embodiment is shown in FIG. 4. A controller 60 within the image forming apparatus 100 may determine whether the cartridge 1 is new (operation S402). This may be done, for example, by determining whether the status indicating element 2 in the cartridge is set in a "new" or "used" state. For example, if the status indicating element 2 is a fusible resistor, the controller can determine whether the fusible resistor has been short-circuited, indicating that the cartridge 1 is "used."

If it is determined that the cartridge 1 is "new," the image forming apparatus 100 may be initialized to operate with the cartridge 1 (operation S404). Initialization may include resetting information stored in a memory unit 30 regarding developer levels in the cartridge 1. On the other hand, if it is determined that the cartridge 1 is "used," the controller 60 may adjust the image forming settings of the image forming apparatus 100 to correspond with the developer levels in the cartridge 1 (operation S406). For example, the controller 60 may access a memory unit 30 to retrieve stored information regarding the developer levels in cartridge 1. The controller 60 may also direct an image forming unit 10 within the image forming apparatus to retrieve developer levels from the cartridge 1 to correspond to the amount of developer used by the cartridge 1.

The image forming apparatus 100 may then notify a user whether the cartridge 1 is "new" or "used" (operations S408, S410).

Upon receiving print data (operation S412), the image forming apparatus 100 forms a print image (operation S414). For example, the controller 60 may direct the image forming unit 10 to retrieve developer from the cartridge 1 and apply the developer to a printing medium. The controller 60 may monitor the print image to determine the amounts of developer used by the cartridge 1 (operation S416). For example, the controller 60 may monitor printed dots within the print image.

As the controller 60 monitors the developer used by the cartridge 1, the controller 60 may access the memory unit 30 and update information stored within the memory unit 30 regarding the developer levels in the cartridge 1 (operation S418). The controller 60 may perform a comparison of the developer used by the cartridge 1 and a predetermined level of developer. If the level of developer used is greater than the predetermined level (operation S420), the controller 60 may direct a status setting unit 50 within the image forming apparatus 100 to set the status of the status indicating element 2 within the cartridge to "used" (operation S422). The predetermined level may be any level set by a manufacturer or by the user at which the cartridge is considered "used." For example, the predetermined level may be 5%. In other words, when 5% of the developer is the cartridge is used, then the cartridge is considered a used cartridge rather than a new cartridge.

The image forming apparatus 100 may continue the print operation after the status indicating element 2 is set. In addition, the controller 60 may determine whether the cartridge 1 is authentic before determining whether the cartridge 1 is "new" or "used." The controller 60 may determine whether the cartridge is "new" or "used" only if it is determined that the cartridge is authentic. If it is determined that the cartridge is not authentic, the controller 60 may limit the functionality of the image forming apparatus 100.

As described above, the present general inventive concept provides an image forming apparatus and a control method thereof, which can induce a user to use an authenticated cartridge and prevent an image from being deteriorated and a component from being worn due to use of a non-authentic cartridge.

Further, the present general inventive concept provides an image forming apparatus and a control method thereof, which can notify a user whether a cartridge is authentic, thereby improving reliability of a product.

Also, the present general inventive concept provides an image forming apparatus and a control method thereof, which can determine and inform a user whether a cartridge is new or used, thereby preventing an error due to a user's mistake in selection when the cartridge is mounted.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A control method of an image forming apparatus, comprising:

mounting a cartridge to an image forming apparatus, the cartridge comprising identification information and a status indicating element;

determining whether the cartridge is new based on the identification information and status information of the status indicating element; and setting initial settings with respect to the cartridge if it is determined that the cartridge is new, wherein the status information of the status indicating element comprises information about whether the status indicating element is short-circuited.

2. The control method according to claim 1, wherein setting the initial settings comprises:

resetting previously stored information about an amount of developer used; and forming an image based on a predetermined test pattern.

3. The control method according to claim 1, further comprising forming an image based on information previously stored in the image forming apparatus about an amount of developer used if it is determined that the cartridge is a used one.

4. The control method according to claim 1, further comprising notifying a user that the cartridge is a new one or a used one.

5. The control method according to claim 1, further comprising short-circuiting the status indicating element if an amount of used developer in the cartridge is equal to or larger than a preset value.

6. The control method according to claim 5, wherein short-circuiting the status indicating element comprises applying a current having not less than a predetermined value to the status indicating element.

7. The control method according to claim 1, further comprising determining whether the cartridge is authenticated based on the identification information of the cartridge.

8. The control method according to claim 7, further comprising, if the cartridge is not authenticated, at least one of (1) disabling the image forming apparatus from forming an image or (2) restricting at least one function of the image forming apparatus.

9. The control method according to claim 8, further comprising notifying a user whether use of the image forming apparatus is restricted.

10. An image forming apparatus comprising:

an image forming unit to form an image based on image data;

a mounting unit to which a cartridge comprising a status indicating element is mounted; and a controller to determine whether the cartridge is a new one based on at least one of identification information of the cartridge and status information of the status indicating element, and to set initial settings with respect to the cartridge if it is determined that the cartridge is a new one, wherein the status information of the status indicating element comprises information about whether the status indicating element is short-circuited.

11. The image forming apparatus according to claim 10, further comprising a memory unit to store information about an amount of developer used by the cartridge, wherein the controller sets the initial settings by controlling the image forming unit to reset the information previously stored in the memory unit about the amount of developer used by the cartridge, and to form an image based on a predetermined test pattern.

12. The image forming apparatus according to claim 10, further comprising a memory unit to store information about an amount of developer used by the cartridge, wherein if it is determined that the mounted cartridge is a used one, the controller controls the image forming unit to form an image on the basis of the information previously stored in the memory unit about the amount of the used developer.

13. The image forming apparatus according to claim 10, further comprising a notifying unit to notifying a user of the status information of the image forming apparatus, wherein the controller controls the notifying unit to notify a user that the cartridge is a new one or a used one according to results from determining whether the cartridge is a new one.

14. The image forming apparatus according to claim 10, further comprising a status setting unit to short-circuit the status indicating element, wherein the controller controls the status setting unit to short-circuit the status indicating element if an amount of developer used by the mounted cartridge is equal to or larger than a preset value.

15. The image forming apparatus according to claim 14, wherein the controller controls the status setting unit to short-circuit the status indicating element by applying a current having not less than a predetermined value to the status indicating element.

16. The image forming apparatus according to claim 10, wherein the controller determines whether the cartridge is authenticated based on the identification information of the cartridge.

17. The image forming apparatus according to claim 16, wherein, if it is determined that the cartridge is not authentic, the controller disables the image forming apparatus from forming an image or restricts at least one function of the image forming apparatus.

18. The image forming apparatus according to claim 17, further comprising a notifying unit to notify a user the status information of the image forming apparatus, wherein the controller controls the notifying unit to notify a user whether use of the image forming apparatus is restricted.

19. A method to control an image forming apparatus, comprising:

determining whether a cartridge is new or used based on status indicating data provided by the cartridge;

if the cartridge is determined to be new, initializing the image forming apparatus to use the cartridge; and if the cartridge is determined to be "used," adjusting an output of the image forming apparatus to accommodate a level of developer used by the cartridge, wherein the status indicating data comprises information about whether a status indicating element is short-circuited.

20. The method according to claim 19, further comprising determining whether the cartridge is authentic based on authentication data provided by the cartridge, wherein determining whether the cartridge is new or used is performed only if it is determined that the cartridge is authentic.

21. The method according to claim 20, further comprising, if it is not determined that the cartridge is authentic, preventing access to at least one function of the image forming apparatus that is accessible when it is determined that a cartridge is authentic.

22. The method according to claim 19, further comprising:

continually monitoring an image output of the image forming apparatus to determine the level of developer used by the cartridge; and storing information regarding the level of developer used by the cartridge in the image forming apparatus.

* * * * *

UNITED STATES PATENT AND TRADEMARK OFFICE

CERTIFICATE OF CORRECTION

PATENT NO. : 8,036,542 B2
APPLICATION NO. : 12/570245
DATED : October 11, 2011
INVENTOR(S) : Cheol-min Jeon It is certified that error appears in the above-identified patent and that said Letters Patent is hereby corrected as shown below:

Title Page; please insert,

Section --(30) Foreign Application Priority Data

January 8, 2009 (KR).....10-2009-0001571--

Signed and Sealed this
Twelfth Day of June, 2012

David J. Kappos

David J. Kappos
*Director of the United States Patent and Trademark Office*